US007685999B2

(12) United States Patent
Toriyama et al.

(10) Patent No.: US 7,685,999 B2
(45) Date of Patent: Mar. 30, 2010

(54) IGNITION CONTROL DEVICE FOR INTERNAL COMBUSTION ENGINE

(75) Inventors: Makoto Toriyama, Chiryu (JP); Yuhki Yamauchi, Kariya (JP)

(73) Assignee: Denso Corporation, Kariya (JP)

( * ) Notice: Subject to any disclaimer, the term of this patent is extended or adjusted under 35 U.S.C. 154(b) by 318 days.

(21) Appl. No.: 11/945,904

(22) Filed: Nov. 27, 2007

(65) Prior Publication Data

US 2008/0127937 A1 Jun. 5, 2008

(30) Foreign Application Priority Data

Dec. 5, 2006 (JP) ..... 2006-328069

(51) Int. Cl.
*F02P 3/045* (2006.01)
*F02P 3/05* (2006.01)
*F02P 15/08* (2006.01)

(52) U.S. Cl. ..... 123/620; 123/636; 123/637

(58) Field of Classification Search ..... 123/620, 123/636, 637
See application file for complete search history.

(56) References Cited

U.S. PATENT DOCUMENTS 4,868,730 A * 9/1989 Ward ..... 363/21.12
4,996,967 A * 3/1991 Rosswurm et al. ..... 123/598
5,056,496 A 10/1991 Morino et al.
5,404,860 A * 4/1995 Morino ..... 123/605
5,568,801 A * 10/1996 Paterson et al. ..... 123/598
2003/0034017 A1* 2/2003 Wilkinson ..... 123/620
2003/0056773 A1* 3/2003 Dutt et al. ..... 123/598
2003/0089355 A1* 5/2003 Vogel et al. ..... 123/620
2006/0021607 A1 2/2006 Toriyama

* cited by examiner

*Primary Examiner*—Erick Solis
(74) *Attorney, Agent, or Firm*—Nixon & Vanderhye PC

(57) ABSTRACT

An ignition control device for controlling a multi-spark operation comprises: a secondary electric energy generator generating an electric energy to reignite an air fuel-mixture associated with an internal combustion engine during the multi-spark operation; a switching element capable of controlling the supplying of the electric energy to a primary coil of an ignition coil, the controlling causing a secondary current in a secondary coil of the ignition coil; an ignition timing signal generator generating an ignition timing signal based on a driving state of the engine; a multi-spark period setting element setting a multi-spark period of the multi-spark operation based on the ignition timing signal; and an ignition control element setting an amount of electric power supplied to the secondary electric energy generator based on the multi-spark period before the performing of the multi-spark operation is started, and for controlling the switching element.

18 Claims, 11 Drawing Sheets

IGNITION CONTROL DEVICE FOR INTERNAL COMBUSTION ENGINE

CROSS REFERENCE TO RELATED APPLICATION

The present application is based on and claims priority to Japanese Patent Application No. 2006-328069 filed on Dec. 5, 2006, the disclosure of which is incorporated herein by reference.

FIELD OF THE INVENTION

The present invention relates to an ignition control device for an internal combustion engine. More specifically, the present invention relates to an ignition control device for performing an ignition using a multi-spark operation during every combustion stroke.

BACKGROUND OF THE INVENTION

An ignition device typically includes a spark plug, for example, in the case of a spark-ignition internal combustion engine. The spark plug ignites an air-fuel mixture by means of an electrical spark. A multi-spark method of igniting the air-fuel mixture has been proposed in recent years, in which the ignition device ignites the air-fuel mixture by means of a multi-spark operation for every combustion stroke in order to improve a combustion state of the air-fuel mixture. During a period of the multi-spark operation, the spark plug repeatedly generates a spark.

In order to perform the multi-spark operation, an ignition control device requires information on a time when the multi-spark operation is started such as a spark timing and a period during which the multi-spark operation is performed such as a multi-spark period. The spark timing and the multi-spark period are, for example, determined by an engine control unit, an electronic control unit, or the like, any of which is referred to herein as the ECU, based on a driving state of the internal combustion engine. In the above-described case, the ignition control device requires receiving both a spark timing signal and a multi-spark period signal from the ECU, where the spark timing signal and the multi-spark period signal include information on the spark timing and the multi-spark period, respectively.

In a conventional case, such as is described in U.S. Patent Application Publication No. 2006/0021607, the ECU outputs the spark timing signal to the ignition control device, and then the ECU outputs the multi-spark period signal to the ignition control device. Consequently, after the spark plug starts generating a spark based on the spark timing signal, the spark plug performs the multi-spark operation during a predetermined period based on the multi-spark period signal. However, in advance of a time when the spark plug starts generating a spark, the ignition control device can not recognize an expected energy consumption or an energy density during the multi-spark operation. Therefore, an amount of energy sufficient to cover all relevant conditions is necessarily supplied to an ignition coil from an electrical energy generator whether the conditions are likely or unlikely. By covering all of the relevant conditions, a large energy is supplied regardless of an ignition condition, and a negative influence on fuel-efficiency is caused.

SUMMARY OF THE INVENTION

In view of the above-described problem, it would be desirable for an ignition control device to recognize the expected energy consumption for the ignition in advance of the ignition timing. It would be also desirable for an ignition control device to reduce the energy consumption and improve the fuel-efficiency.

In view of the above-described problem, it is an object of the present disclosure to provide an ignition control device.

According to a first aspect of the present disclosure, an ignition control device for controlling a multi-spark operation associated with an internal combustion engine) the ignition control device comprises: an ignition coil including a primary coil and a secondary coil; a first electric energy generator for generating a first electric energy; a second electric energy generator for generating a second electric energy, a voltage of the second electric energy being larger than a voltage of the first electric energy; a switching element capable of controlling the supplying of the first electric energy and the second electric energy to the primary coil by switching on and off, the switching causing a secondary current of the secondary coil; an ignition timing signal generator for generating an ignition timing signal having a pulse waveform based on a driving state of the internal combustion engine; a multi-spark period setting element for setting a multi-spark period of the multi-spark operation based on a width of the ignition timing signal; and an ignition control element for setting an amount of electric power supplied to the first electric energy generator and the second electric energy generator based on the multi-spark period set by the multi-spark period setting element, and for controlling the switching element.

According to the above the ignition control device, the multi-spark period setting element can set the multi-spark period of the multi-spark operation based on the width of the ignition timing signal. The multi-spark period setting element can recognize an ignition timing and the multi-spark period before the performing of the multi-spark operation is started. The amount of electric power supplied to the first electric energy generator and the second electric energy generator can be set before the performing of the multi-spark operation is started. It is possible to improve the fuel-efficiency.

According to a second aspect of the present disclosure, an ignition control device for controlling a multi-spark operation associated with an internal combustion engine, the ignition control device comprises: a secondary electric energy generator generating an electric energy to reignite an air fuel-mixture associated with the internal combustion engine during the multi-spark operation; a switching element capable of controlling the supplying of the electric energy to a primary coil of an ignition coil, the controlling causing a secondary current in a secondary coil of the ignition coil; an ignition timing signal generator generating an ignition timing signal based on a driving state of the internal combustion engine; a multi-spark period setting element setting a multi-spark period of the multi-spark operation based on the ignition timing signal; and an ignition control element setting an amount of electric power supplied to the secondary electric energy generator based on the multi-spark period before the performing of the multi-spark operation is started, and for controlling the switching element.

According to the above the ignition control device, the multi-spark period setting element can set the multi-spark period of the multi-spark operation based on the ignition timing signal. The multi-spark period setting element can recognize the multi-spark period before the performing of the multi-spark operation is started. The amount of electric power supplied to the secondary electric energy generator can be set before the performing of the multi-spark operation is started. It is possible to improve the fuel-efficiency.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

First Embodiment

Figure 2:
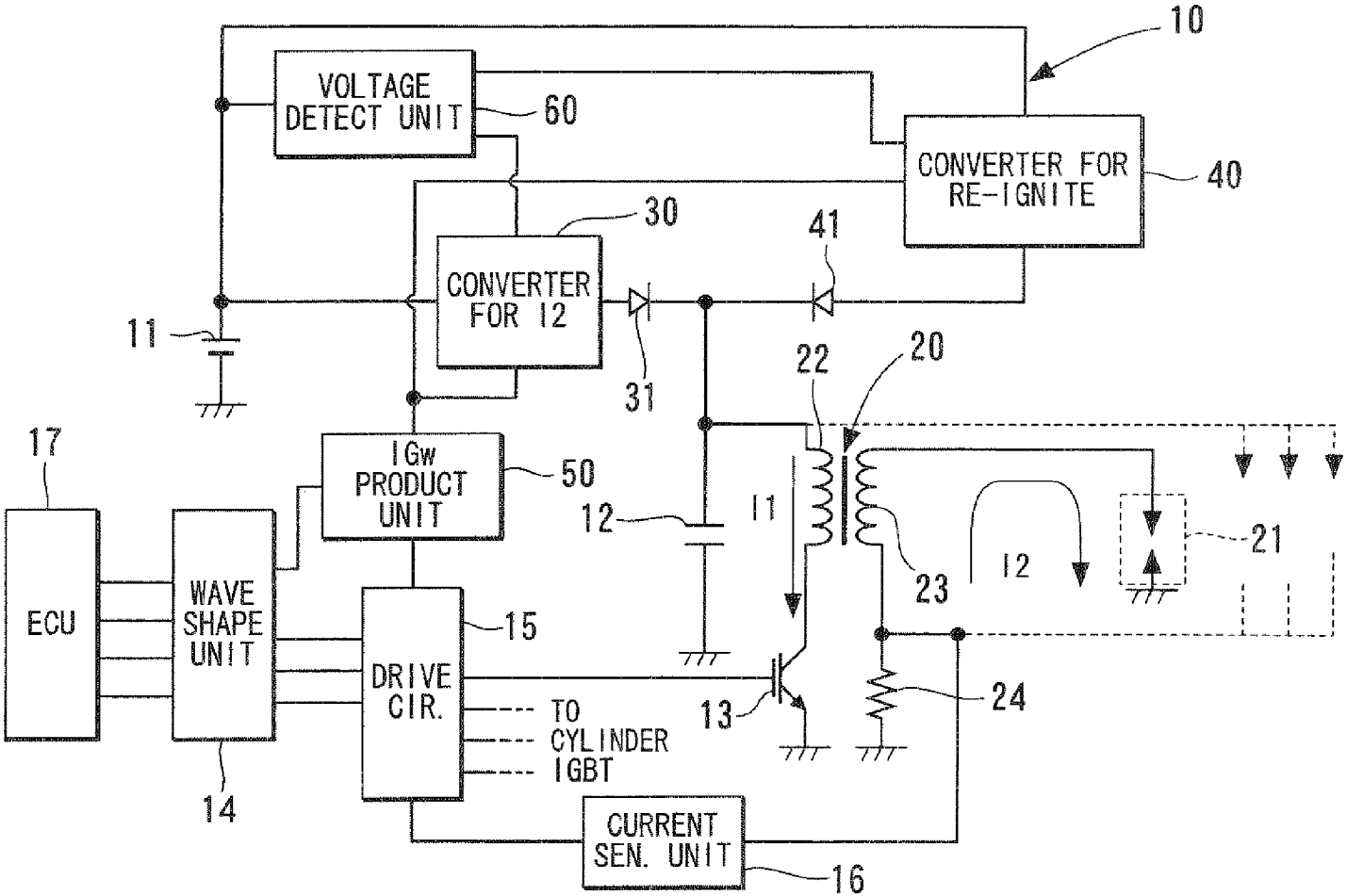
FIG. 2 is a schematic diagram illustrating an ignition control device according to the first embodiment.

An ignition control device 10, for example as shown in FIG. 2, includes a DC power source such as a battery 11, a first electric energy generator such as a first DC/DC converter 30, a second electric energy generator such as a second DC/DC converter 40, an charging element such as a first capacitor 12, an ignition coil 20, a switching element such as an insulated gate bipolar transistor (IGBT) 13, a waveform shaping unit 14, an ignition control element such as a drive circuit 15, an ignition timing signal generator such as an IGw production unit 50, a supply voltage detection unit 60, and a current sensing unit 16. The ignition coil 20 is coupled with a spark plug 11. The ignition control device 10 is coupled with an ECU 17. The ignition control device 10 generates an ignition timing signal. When the ECU 17 commands the ignition, the spark plug 20 of the ignition control device 10 generates a spark.

The battery 11 is coupled with the first DC/DC converter 30 and the second DC/DC converter 40. Since an air-fuel mixture in a combustion chamber has a high flow speed in lean burn or super lean burn condition, the ignition control device 10 includes the first DC/DC converter 30 and the second DC/DC converter 40 which supplies enough voltage to the spark plug 21 to perform the multi-spark operation. The first DC/DC converter 30 and the second DC/DC converter 40 step up a voltage supplied from the battery 11, and output the stepped up voltages. The first DC/DC converter 30 generates a first electrical energy. The second DC/DC converter 40 generates a second electrical energy. The first DC/DC converter 30 and the second DC/DC converter 40 supply an electrical energy to the ignition coil 20, and the spark plug 21 ignites the air-fuel mixture.

Figure 3:
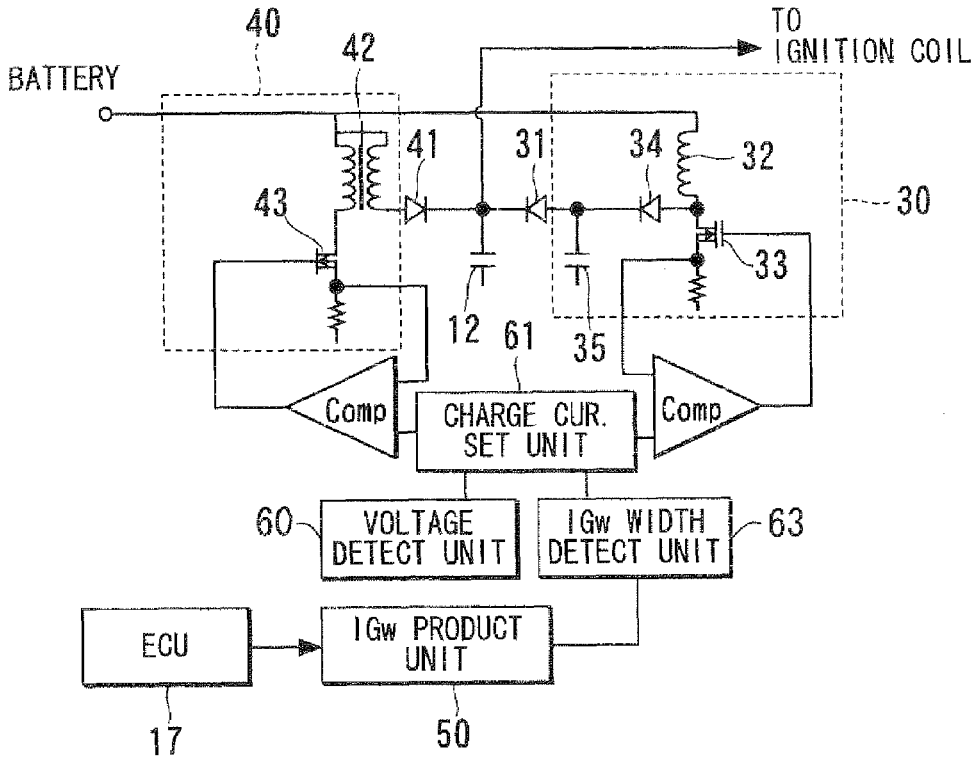
FIG. 3 is a schematic diagram illustrating a DC/DC converter and a supplied voltage detection of the ignition control device according to the first embodiment.

The first DC/DC converter 30 supplies an electrical power to the ignition coil 20 in order to ensure a secondary current of the ignition coil 20. An output voltage Vdc of the first DC/DC converter 30 is in a range between a few dozen V and a few hundred V. The first DC/DC converter 30 is connected in series to a primary coil 22 of the ignition coil 20 via a first diode 31. The first diode 31 blocks a current in the opposite direction. The first DC/DOC converter 30 includes a first step-up circuit. As shown in FIG. 3, the first step-up circuit includes an inductor 32, a transistor 33, a third diode 34 and a second capacitor 35. Alternatively, the first DOC/D converter 30 may include a transformer instead of the inductor 32. Alternatively, the first DC/DC converter 30 may further include a plurality of inductors and a plurality of transformers.

Since the air-fuel mixture has a higher flow speed in a lean burn condition, the ignition coil 20 needs to have a higher voltage in order to repeatedly ignite the air-fuel mixture during the multi-spark operation. Therefore the ignition control device 10 includes the second DC/DC converter 40 for re-igniting the air-fuel mixture during the multi-spark operation, in addition to the first DC/DC converter 30 for ensuring a secondary current of the ignition coil 20. The second DC/DC converter 40 is also referred to herein as a secondary electric energy generator. An output voltage of the second DC/DC converter 40 is several hundred volts. The second DC/DC converter 40 is connected in series to the primary coil 22 of the ignition coil 20 via a second diode 41. The second diode 41 blocks a current in the opposite direction. The second DC/DC converter 40 includes a second step-up circuit. As shown in FIG. 3, the second step-up circuit includes a transformer 42 and a transistor 43. Alternatively, the second DC/DC converter 40 may include an inductor instead of the transformer 42. Alternatively the second DC/DC converter 40 may further include a plurality of transformers and a plurality of inductors.

The first capacitor 12 is connected in series to the battery 11 via the first DC/DC converter 30 or the second DC/DC converter 40, as shown in FIG. 2. The first capacitor 12 stores the electrical energy supplied from the battery 11 through the first DC/DC converter 30 or the second DC/DC converter 40. More specifically, the first capacitor 12 can be energized at any time and stores the electrical energy from the first DC/DC converter 30 and the second DC/DC converter 40. The ignition coil 20 includes the primary coil 22 and a secondary coil 23. One end of the primary coil 22 is connected to the first capacitor 12, and the other end of the primary coil 22 is connected to the IGBT 13. One end of the secondary coil 23 is connected to the spark plug 21, and the other end of the secondary coil 23 is connected to a resistor 24. The resistor 24 is an element for detecting a current.

The IGBT 13 is connected in series to the primary coil 22. The IGBT 13 works as a switch. When the IGBT 13 is turned to an ON condition, the electrical energy stored in the first capacitor 12 is released. The released energy is supplied to the primary coil 22. When the IGBT 13 is turned to an OFF condition, the first capacitor 12 stores the electrical energy supplied from the battery 11 through the first DC/DC converter 30 or the second DC/DC converter 40.

In the present disclosure, the voltage across the first capacitor 12 is described as Vc, and the voltage across the spark plug 21 is described as V2. The direction of the current flow from the battery 11 to the primary coil 22 is defined as the positive direction. The current flowing toward the primary coil 22 is described as a primary current I1. The direction of the current flow from the secondary coil 23 to the spark plug 21 is defined as the positive direction. The current flowing toward the secondary coil 23 is described as the secondary current I2.

The ECU 17 includes a microcomputer having a Central Processing Unit (CPU), a Read-Only Memory (ROM) and a memory such as Random Access Memory (RAM) which, since they are well known element, are not shown in the figures. The ECU 17 executes various programs stored in the ROM, and the ECU 17 controls a driving state of the engine as well as the ignition control device 10. For controlling the ignition timing, the ECU 17 collects an information item including or indicating the driving state of the engine, such as a rotation speed of the engine, a position of a gas pedal and the like. The ECU 17 calculates or determines appropriate ignition timing based on the collected information items. The ECU 17 outputs an ignition timing signal IGt to the ignition control device 10 via the waveform shaping unit 14. The waveform shaping unit 14 shapes a waveform of the ignition timing signal IGt in order to match the signal IGt to each cylinder of the engine.

The IGw production unit 50 produces a multi-spark period signal IGw based on the ignition timing signal IGt transferred from the ECU 17 via the waveform shape unit 14. The multi-spark period signal IGw sets a multi-spark period, where the multi-spark period is a period during which the multi-spark operation is to be performed.

The drive circuit 15 is connected to the IGw production unit 50, the first DC/DC converter 30, the second DC/DC converter 40, the IGBT 13 and the current sensing unit 16. The drive circuit 15 controls the first DC/DC converter 30, the second DC/DC converter 40 and the IGBT 13 based on the ignition timing signal IGt, the multi-spark period signal IGw and the secondary current I2. The drive circuit 15 controls the electric energy to be supplied to the first capacitor 12. The drive circuit 15 outputs a driving signal to the IGBT 13. The driving signal can switch the IGBT 13 between the ON and the OFF condition.

Figure 1:
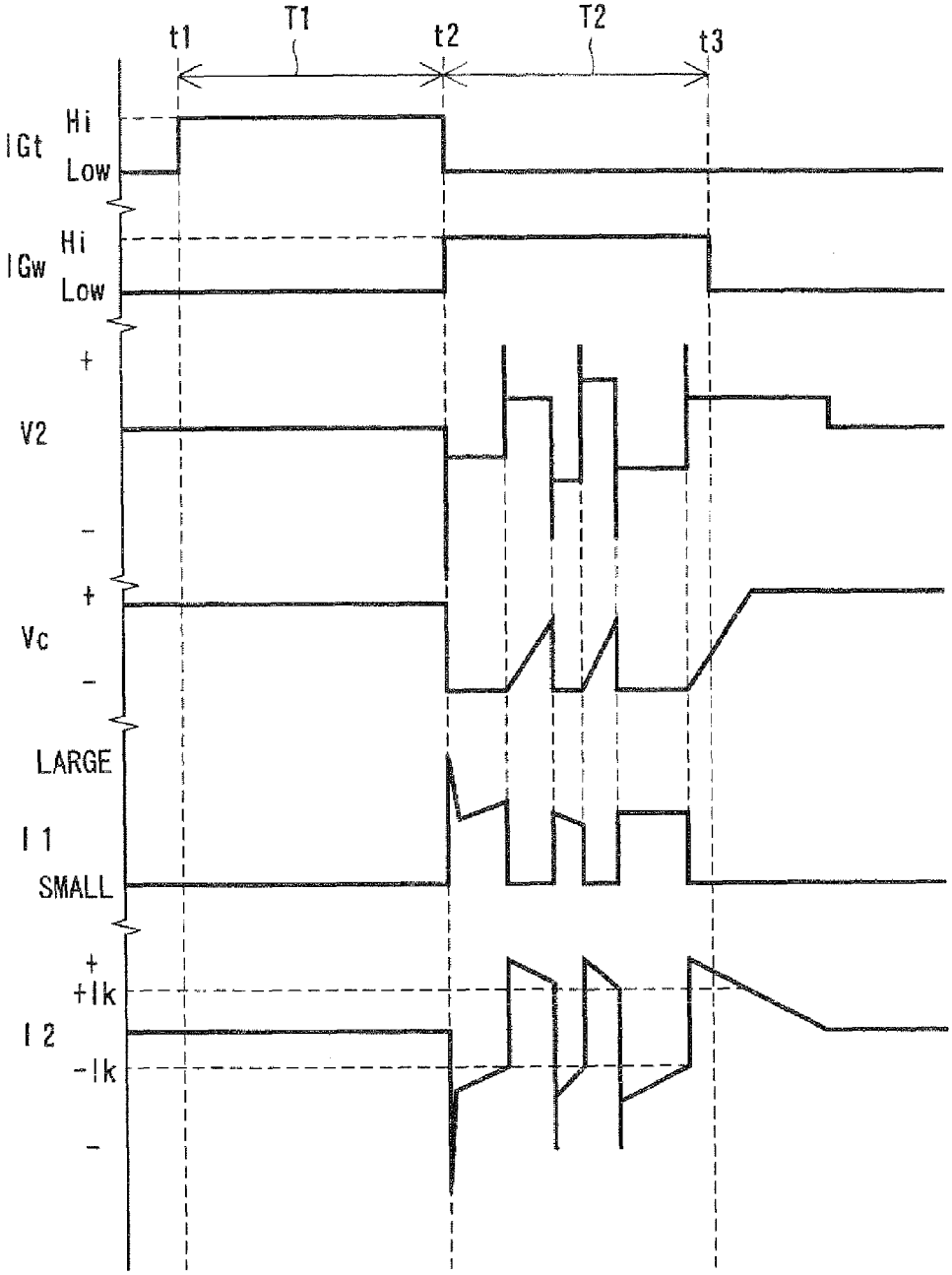
FIG. 1 is a timing diagram illustrating representative ignition timing according to a first embodiment of the present invention.
Figure 4:
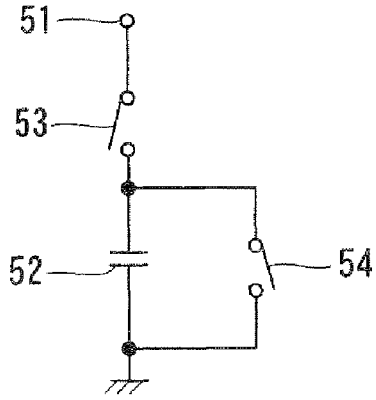
FIG. 4 is a schematic diagram illustrating an IGw production unit of the ignition control device according to the first embodiment.

As shown in FIG. 1, the ECU outputs the ignition timing signal IGt as a pulsed signal. Specifically, the ignition timing signal IGt has the width T1 between a rising edge time t1 and a falling edge time t2. The drive circuit 15 sends the ignition timing signal IGt to the IGw production unit 50 at the rising edge time t1. As shown in FIG. 4, the IGw production unit 50 includes a third capacitor 52 connected to an input terminal 51. The ignition timing signal IGt is input into the input terminal 51. A first switch 53 is disposed between the input terminal 51 and the third capacitor 52. At the rising edge time t1, the first switch 53 is turned on. The third capacitor 52 stores electric charges of the ignition timing signal IGt until the falling edge time t2.

Figure 5:
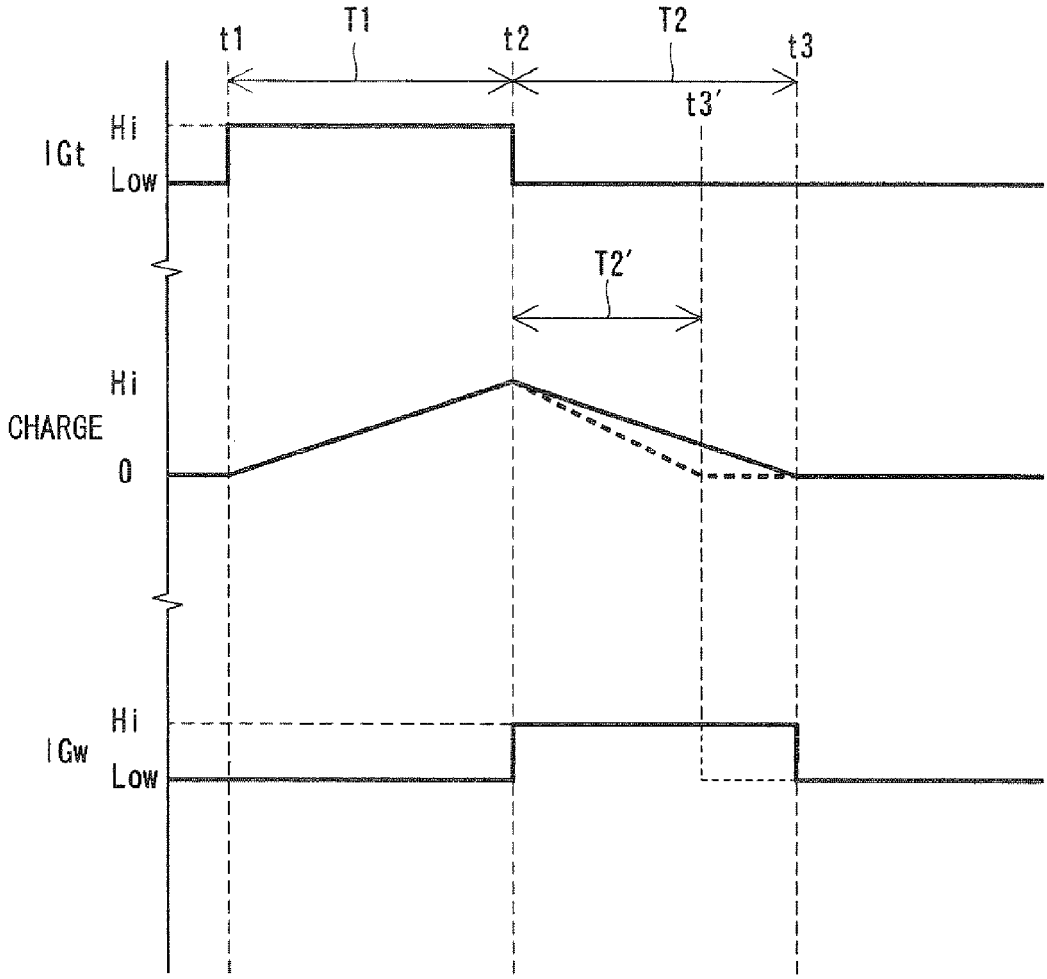
FIG. 5 is a timing diagram illustrating the representative generation of a multi-spark period signal at the IGw production unit of the ignition control device according to the first embodiment.

At the falling edge time t2, the drive circuit 15 stops the third capacitor 52 from being charged. Further, the drive circuit 15 turns the IGBT 13 to the ON condition. As a result, the electrical energy stored in the capacitor 12 is released to the primary coil 22 and thereby causing the spark plug 21 to produce the spark. At the falling edge time t2, the drive circuit 15 turns the first switch 53 off and the second switch 54 on, thereby releasing the electrical energy stored in the third capacitor 52 of the IGw production unit 50. The second switch 54 is disposed in a discharge circuit of the third capacitor 52, as shown in FIG. 4. As shown in FIG. 5, a width of the multi-spark period signal IGw such as a multi-spark period T2 is related to or corresponds to a period during which third capacitor 52 releases the stored electrical energy. The spark plug 21 may perform the multi-spark operation while the IGBT is in the ON condition or while the electrical energy stored in the third capacitor 52 is being released.

The IGw production unit 50 produces the multi-spark period signal IGw based on the ignition timing signal IGt output from the ECU 17. When a ratio of the charging period to the discharging period of the third capacitor 52 is changed, a ratio of the width of the multi-spark period signal IGw, which associated with the multi-spark period signal T2, to the width T1 of the ignition timing signal is changed. More specifically, when the discharging period of the third capacitor 52 is changed into the period approximately equal to the charging period of the third capacitor 52, the multi-spark period T2 is changed into the period approximately equal to the width T1 of the ignition timing signal IGt, as shown in FIG. 5. Alternatively, when the ratio of the charging period to the discharging period of the third capacitor 52 is changed properly, the multi-spark period T2 is changed into a period T2' expressed as $T2'=\alpha T1$, where $\alpha$ is a predetermined ratio. The predetermined ratio is set in accordance with the driving state of the internal combustion engine or an inherent characteristic of the internal combustion engine. FIG. 5 shows two cases of the ratio such as where $T1=T2$ and where $T1>T2$. The ignition control device 10 may operate in the other case of the ratio such as where $T1<T2$.

At the rising edge t1 of the ignition timing signal IGt, the drive circuit 15 starts to charge the third capacitor 52. At the falling edge t2, the drive circuit 15 turns the IGBT 13 to the ON condition, and the spark plug 21 starts generating the spark. In addition to the above-described procedures, at the falling edge t2, the drive circuit 15 starts discharging the third capacitor 52. The spark plug 21 performs the multi-spark operation while the third capacitor 52 is being discharged. In the above-described manner, the IGw production unit 50 produces the multi-spark period signal IGw including information on the multi-spark period T2 based on the period expressed as $T2'=\alpha T1$. Furthermore, the drive circuit 15 turns the IGBT 13 to the ON condition at the falling edge t2 of the ignition timing signal IGt. Accordingly, the falling edge time t2 is related to or corresponds to a time when the spark plug 21 starts to ignite the air-fuel mixture. In the above-described manner, the IGw production unit 50 produces the multi-spark period signal IGw based on the ignition timing signal IGt.

The supply voltage detection unit 60 detects voltages of the battery 11 the first DC/DC converter 30 and the second DC/DC converter 40, as shown in FIG. 2. The supply voltage detection unit 60 is connected to a charging current setting unit 61, as shown in FIG. 3. In the charging current setting unit 61, the supply voltage detection unit 60 sets a charging current based on the voltage of the battery 11 and the multi-spark period signal IGw produced in the IGw production unit 50. The charging current setting unit 61 sets the amount of the electrical energy to be supplied to the first capacitor 12 via the first DC/DC converter 30 and the second DC/DC converter 40 based on the multi-spark period signal IGw produced in the IGw production unit 50.

Figure 6:
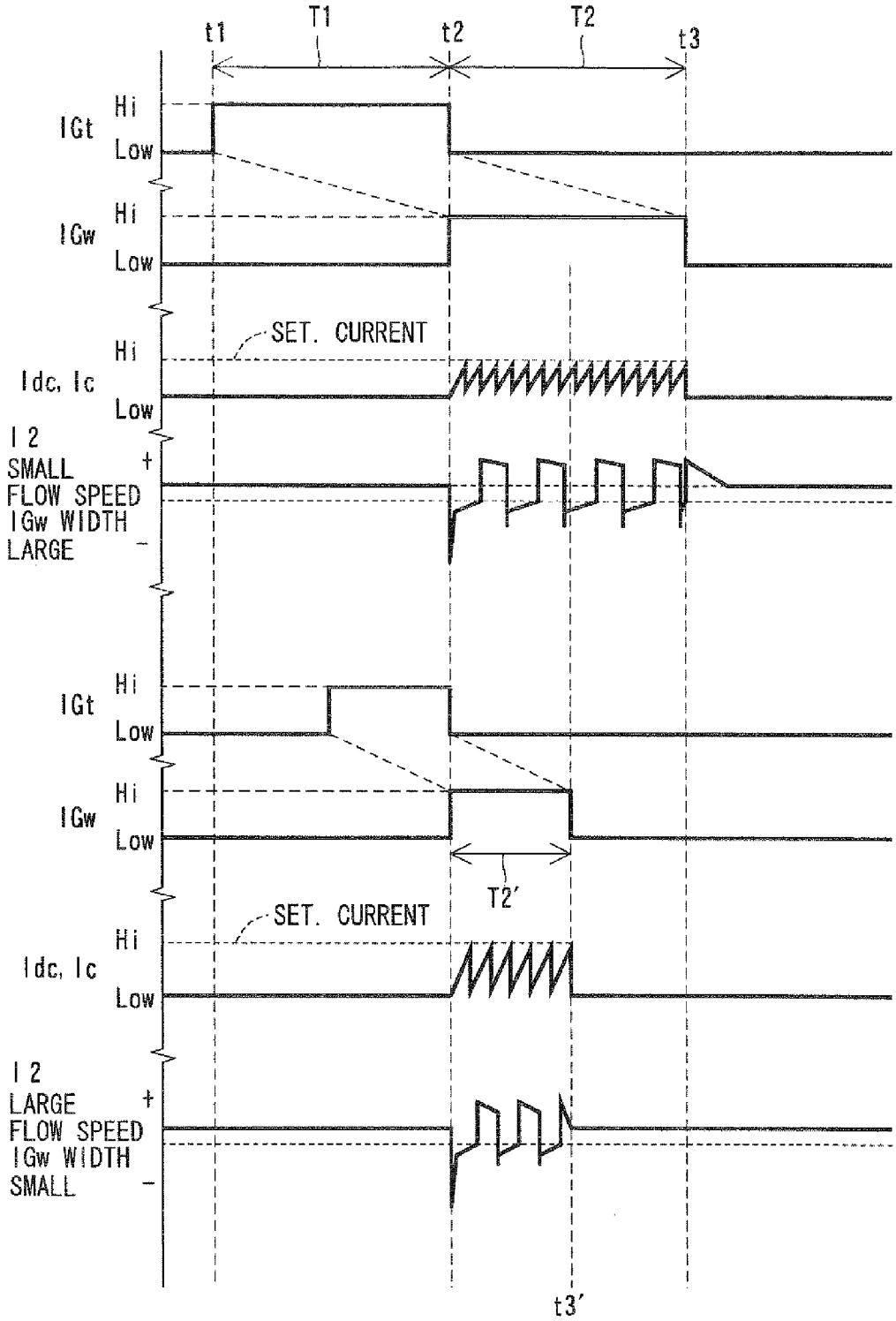
FIG. 6 is a timing diagram illustrating the representative setting of an energy density in the ignition control device according to the first embodiment.
Figure 7:
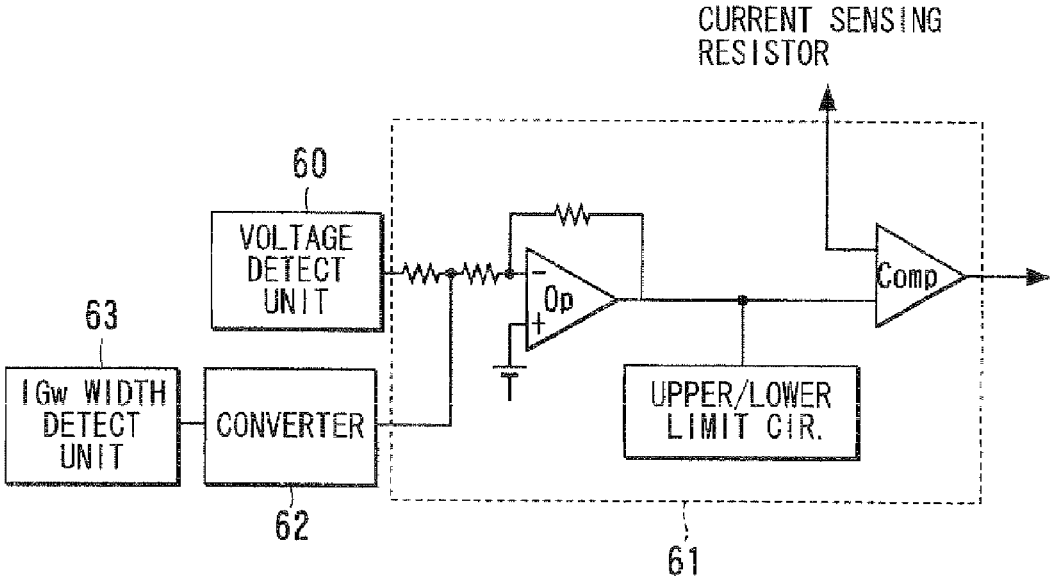
FIG. 7 is a schematic diagram illustrating a charging current setting unit of the ignition control device according to the first embodiment.
Figure 8:
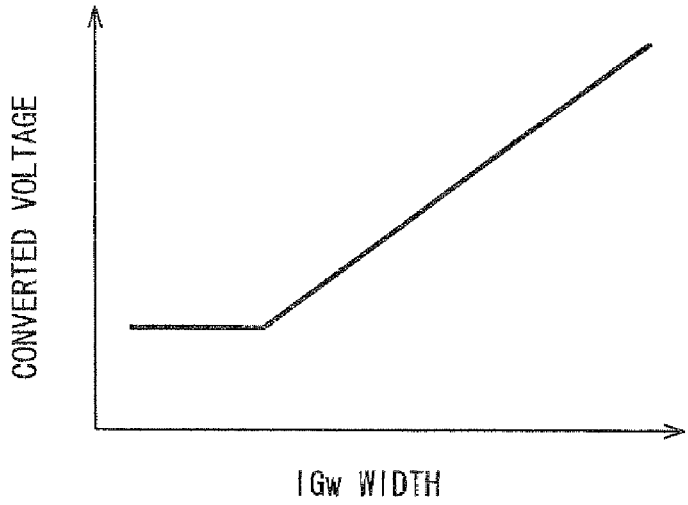
FIG. 8 is a graph illustrating a representative relation between a voltage and the multi-spark period signal IGw in a converter.

The charging current setting unit 61 calculates a value of a setting current, as shown in FIG. 6. Specifically, the charging current setting unit 61 calculates the value of the setting current for charging the first DC/DC converter 30 and the second DC/DC converter 40 based on a predetermined voltage that is set from the multi-spark period signal IGw. The charging current setting unit 61 is coupled with the supply voltage detection unit 60 and a converter 62, as shown in FIG. 7. The converter 62 is coupled with the IGw production unit 50 via an IGw width detection unit 63. The IGw width detection unit 63 detects the width of the multi-spark period signal IGw produced in the IGw production unit 50. The width of the multi-spark period signal IGw detected in the IGw width detection unit 63 is converted into a voltage value by the converter 62. For example, as shown in FIG. 8, the converter 62 generates a converted voltage based on the multi-spark period signal. The converter 61 gives a larger converted voltage as a multi-spark period signal IGw having a larger width of is input.

Figure 9A:
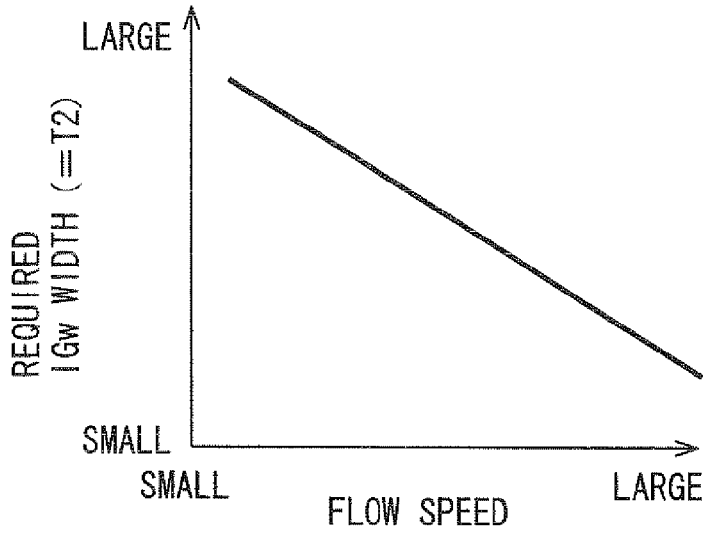
FIG. 9A is a graph illustrating a representative relation between a flow speed of an air-fuel mixture and a multi-spark period.
Figure 9B:
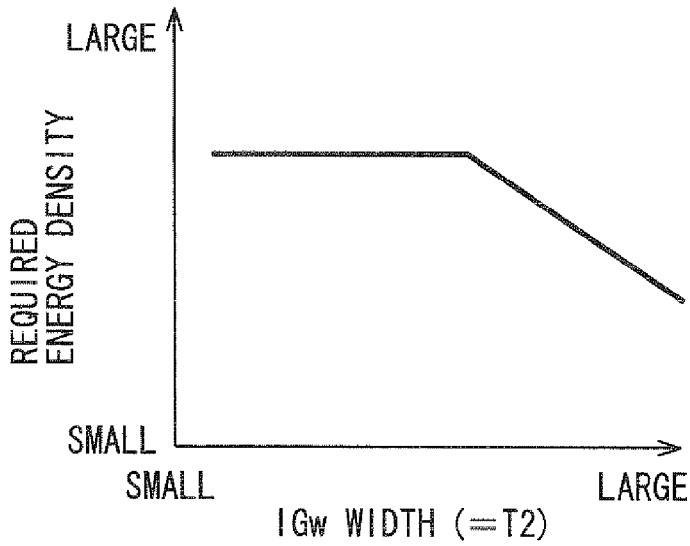
FIG. 9B is a graph illustrating a representative relation between a width of the multi-spark period signal and a required energy density.

When the air-fuel mixture has a small flow speed, the spark plug 21 necessarily discharges for a long time. Thus, as shown in FIG. 9A, as the air-fuel mixture has a smaller flow speed, the required multi-spark period T2 is longer, and the conversion voltage produced in the converter 62 is larger, where the air-fuel mixture flow speed is correlated with engine revolutions. Thus, when the multi-spark period is long, the air-fuel mixture has a small flow speed, and the spark plug 21 discharges a small discharge current, as shown in FIG. 6, and the required energy density is smaller as shown in FIG. 9B.

When the air-fuel mixture has a large flow speed, the spark plug 21 performs the discharge for a smaller time than a case where the air-fuel mixture has a small flow speed. Thus, as shown in FIG. 9A, as the air-fuel mixture has a larger flow speed, the required multi-spark period T2 is shorter, and the conversion voltage produced in the converter 62 is smaller. Thus, when the multi-spark period is short, the spark plug 21 discharges a large discharge current, as shown in FIG. 6, and the amount of the required energy density is increased as shown in FIG. 9B.

Figure 10:
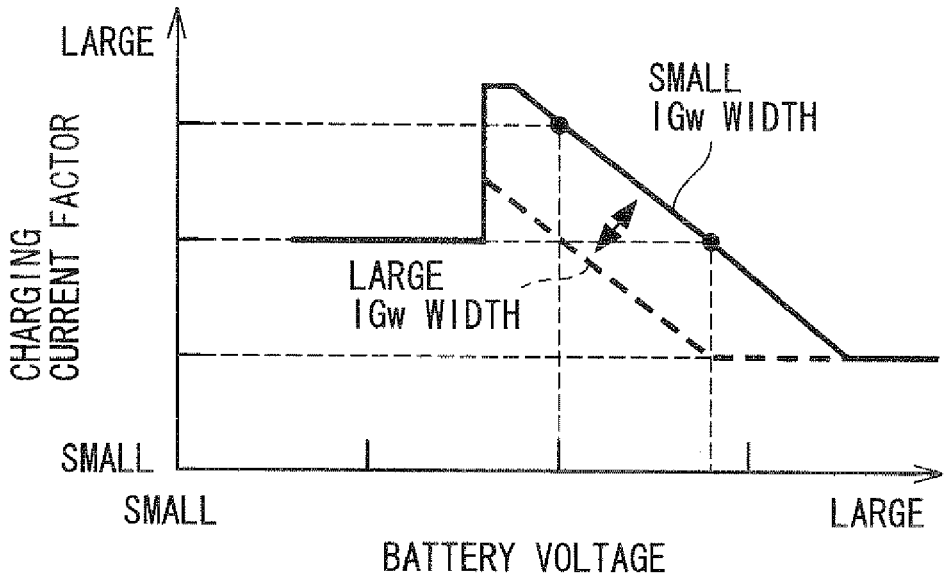
FIG. 10 is a graph illustrating a representative relation between a battery voltage and a charging current factor according to the charging current setting unit of the first embodiment.

As shown in FIG. 6, as the multi-spark period T2 is longer, the currents output from the first DC/DC converter 30 and the second DC/DC converter 40, and the current Ic of the first capacitor 12 are smaller. For the above-described reason, based on the width of the multi-spark period signal IGw, the charging current setting unit 61 sets the value of the current for charging the first DC/DC converter 30 and the second DC/DC converter 40 in such a manner that the energy density and the conversion voltage produced in the converter 62 are inversely proportional to each other. As shown in FIG. 10, the charging current setting unit 61 sets a charging current factor used for determining a value of the charging current for charging the converter 30 and the converter 40, and sets the value of the charging current, based on a voltage of the battery 11. As a result, in advance of the rising edge time t1 of the ignition timing signal IGt, and in advance of starting the spark plug 21 to discharge the amount of the electrical energy to be supplied to converter 30 and the converter 40 is set in accordance with the width of the multi-spark period signal IGw.

The current sensing unit 16 detects a secondary current I2 flowing in the secondary coil 23 of the ignition coil 20. The current sensing unit 16 outputs an electrical signal, such as the detected secondary current I2, to the drive circuit 15. The drive circuit 15 controls the first DC/DC converter 30, the second DC/DC converter 40 and the IGBT 13 based on the secondary current I2 detected in the current sensing unit 16. The primary current I1 flowing in the primary coil 22 of the ignition coil 20 is controlled.

As shown in the timing diagram of FIG. 1, at the falling edge time t2 of the ignition timing signal IGt, the ignition control device 10 commands the spark plug 21 to perform the first spark of the multi-spark operation. The ignition control device 10 then causes the spark plug 21 to repeatedly discharge during the multi-spark period T2, the period being between t2 and t3.

Until the falling edge time t2 of the ignition timing signal IGt, the first capacitor 12 stores the electric energy supplied from the first DC/DOC converter 30. In the present embodiment, the first capacitor 12 stores a sufficient amount of the electrical energy in advance of the ignition timing t2. At the falling edge t2 of the ignition timing signal IGt, the drive circuit 15 outputs the driving signal to the IGBT 13, and turns the IGBT 13 to the ON condition. Then the electrical energy is supplied to the primary coil 22 from the first capacitor 12 and the first DC/DC converter 30. As a result, the spark plug has the secondary voltage V2, such as a plug voltage, larger than dozens of kV, by which the spark is generated. The first capacitor 12 is charged by the electrical energy output from the second DC/DC converter 40. The drive circuit 15 controls the first DC/DC converter 40, the second DC/DC converter 40 and the IGBT 13 in order to maintain the secondary current detected by the current sensing unit 16, and in order for the maintained current to be in the range between +Ik and −Ik, which is a predetermined range of a current associated with discharge maintenance. Thus it is possible for the spark plug 21 to generate a plurality of sparks. During multi-spark period T2, the secondary voltage V2 has both positive and negative voltage cases. The positive voltage case is caused by the primary current flowing in the primary coil 22, and the negative voltage case is caused by the supplying of the voltage to the first capacitor 12.

The charging current setting unit 61 sets the amount of the electrical energy to be supplied to the first DC/DC converter 30 and the second DC/DC converter 40 based on the width T1 of the multi-spark period signal IGw. Therefore, before the spark plug 21 starts discharging, the charging current setting unit 61 can recognize the amount of energy required for the multi-spark spark operation. The energy is stored in the converter 30 and the converter 40.

An ignition control device according to the above-described embodiment includes following advantages.

(1) The width T1 of the ignition timing signal IGt and the falling edge time t2 of the ignition timing signal IGt are, respectively, related to the multi-spark period T2 and the ignition timing. Therefore the drive circuit 15 can recognize the multi-spark period T2 in advance of the ignition timing, which corresponds to the falling edge time t2 of the ignition time signal IGt.

(2) Since the IGw production unit 50 sets the multi-spark period T2 based on the width T1 of the ignition timing signal T1, the drive circuit 15 can recognize the multi-spark period T2 in advance of the ignition timing. Thus, in advance of the ignition timing, the drive circuit 15 can recognize the amount of energy to be supplied to the converter 30 and the converter 40 required during the multi-spark period. It is possible to provide the correct amount of energy to the converter 30 and the converter 40 without providing an excess or insufficient amount thereof. Therefore the amount of energy required during the multi-spark period T2 can be set to be the least amount necessary, and thereby the fuel-efficiency is improved.

(3) The falling edge t2 of the ignition timing signal IGt provides the ignition timing. The setting of the multi-spark period T2 is based on the width T1 of the ignition timing signal IGt. The multi-spark period signal IGw is convolved with the ignition timing signal lt. Thus, since it is not required for the ignition control device 10 to receive the multi-spark period signal from the ECU aside from the ignition timing signal IGt, a number of the lines disposed between the ECU and the ignition control device 10 can be reduced.

Second Embodiment

Figure 11:
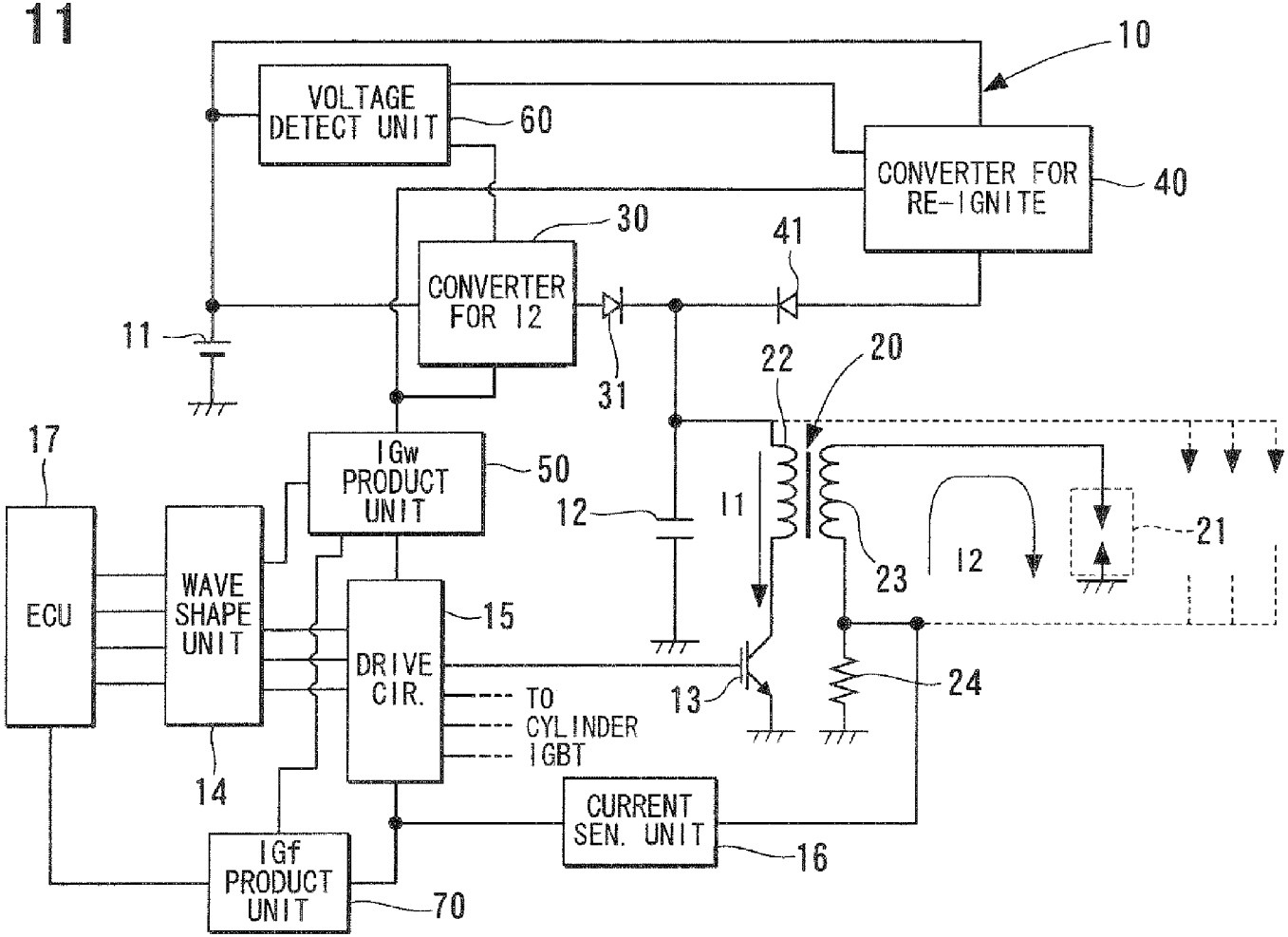
FIG. 11 is a schematic diagram illustrating an ignition control device according to a second embodiment.

FIG. 11 shows an ignition control device according to a second embodiment of the present invention.

Figure 12:
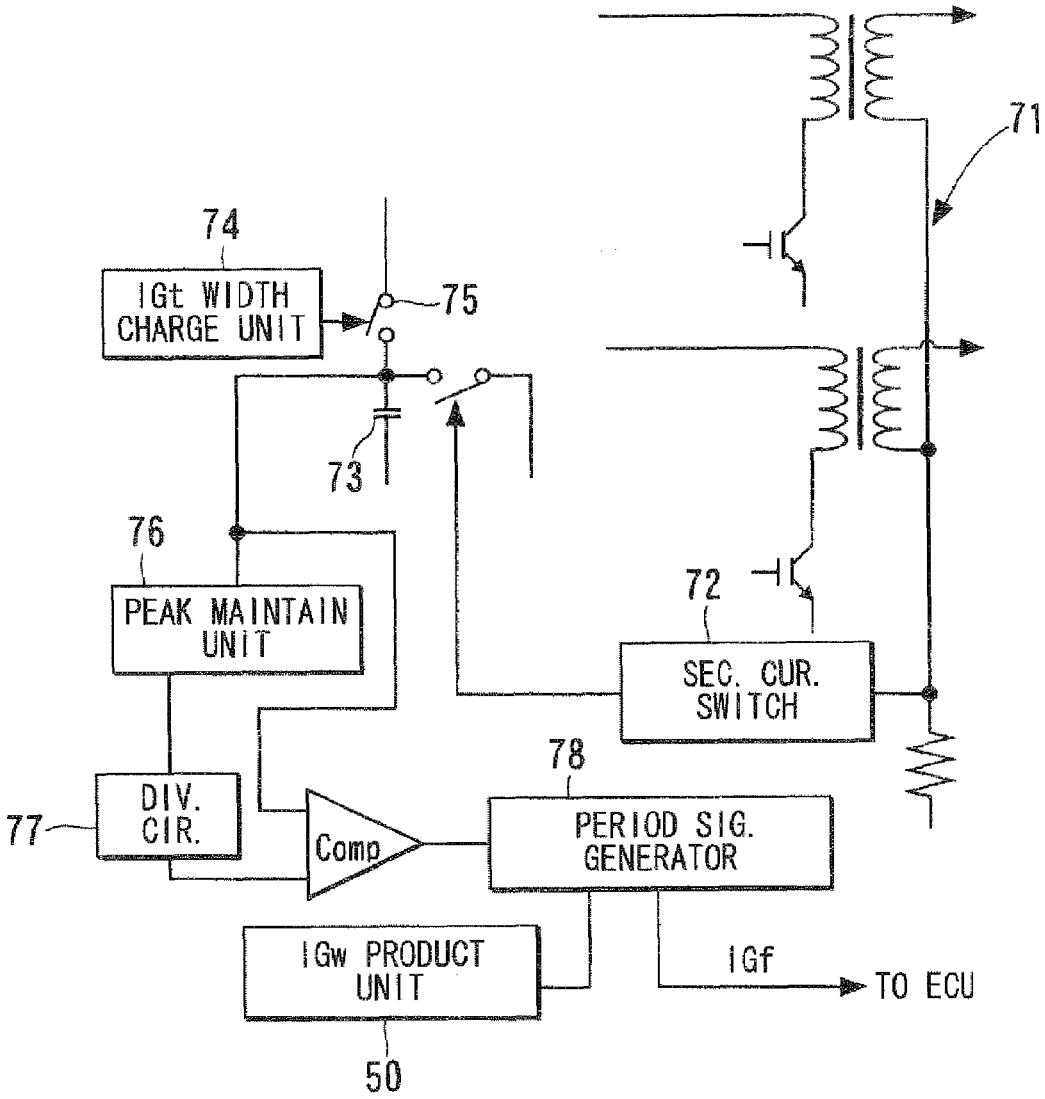
FIG. 12 is a schematic diagram illustrating an IGf signal generation unit according to the second embodiment.
Figure 13:
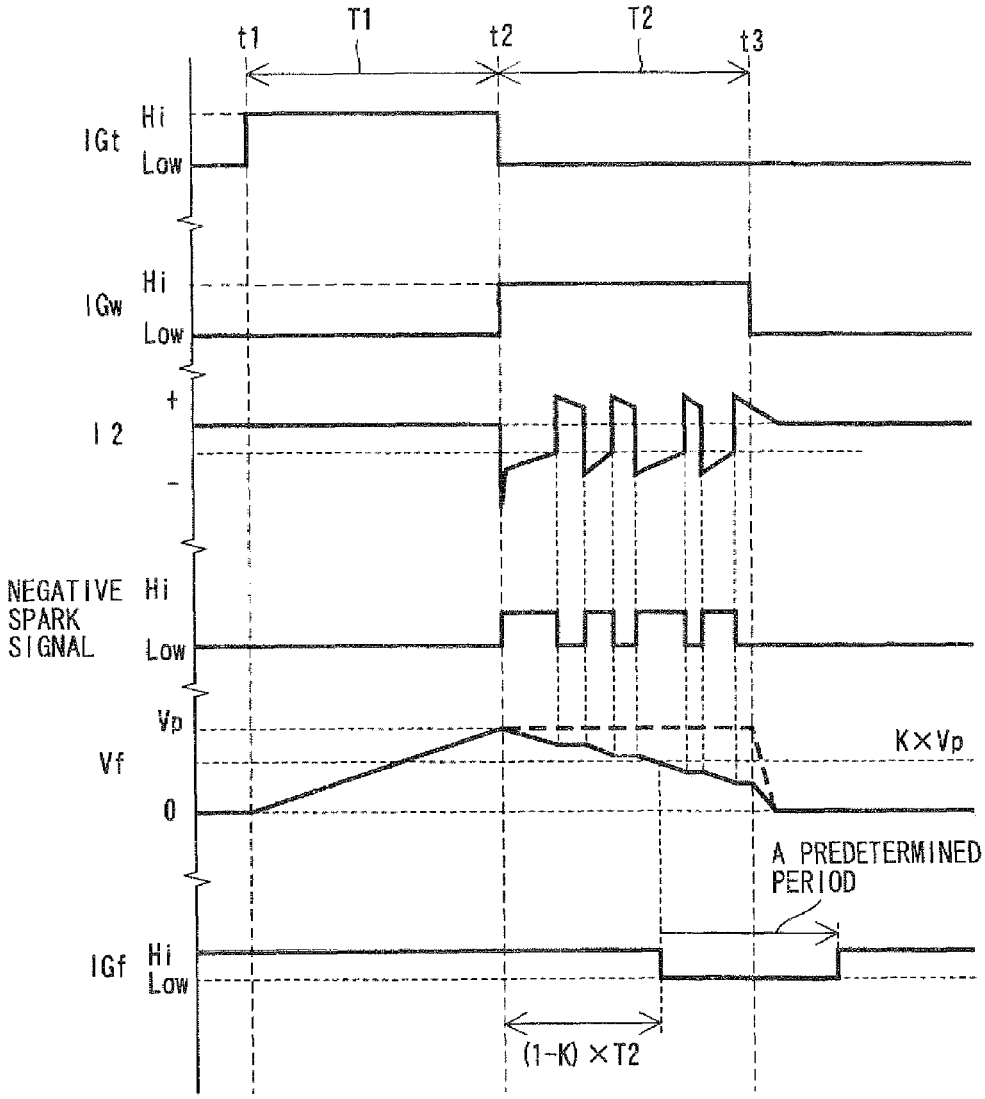
FIG. 13 is a timing diagram illustrating the representative generation of an IGf signal according to the second embodiment.

In the present embodiment, the ignition control device 10 includes an ignition state detection unit such as an IGf signal generation unit 70, as shown in FIG. 11. The IGf signal generation unit 70 outputs a signal IGf that is used as a basis for determining whether the spark plug 21 discharges abnormally. The abnormal discharging of the spark plug 21 is caused by, for example, abnormal behavior of the first DC/DC converter 30 and the second DC/DC converter 40. The IGf signal generation unit 70 includes a signal generator circuit 71 having a secondary current switching element 72, as shown in FIG. 12. The secondary current switching element 72 generates a negative spark signal, as shown in FIG. 13. The negative spark signal is generated when the direction of a current flow at the secondary coil 23 of the ignition coil 20 is negative. As shown in FIG. 13, the charging of a fourth capacitor 73 included in the signal generator circuit 71 depends on the width T1 of the ignition timing signal IGt. When the ignition timing signal IGt is output form the ECU 17, a charging member 74 turns on a third switch 75. After the third switch 75 is turned on, the fourth capacitor 73 stores electrical charges, depending on the width T1 of the ignition timing signal IGt. The voltage of the fourth capacitor 73 is expressed as Vf, as shown in FIG. 13. The maximum voltage of the fourth capacitor 73 is expressed as Vp. Information on a peak voltage of the fourth capacitor 73 is stored in a peak voltage maintenance member 76.

When the secondary current I2 flows in the secondary coil 23 of the ignition coil 20, the secondary current switching element 72 generates the negative spark signal. Every time the negative spark signal is generated, the fourth capacitor 73 releases the stored charges. Thus, the voltage of the fourth capacitor 73 decreases every time the ignition coil 20 generates, for example, a negative discharge, as shown in FIG. 13.

A dividing voltage element 77 of the signal generator circuit 71 compares the voltage Vf of the fourth capacitor 73 to the voltage Vp maintained by the peak voltage maintenance element 76. The dividing voltage element 77 detects a time when the third capacitor has the voltage Vf approximately equal to K times Vp, where K is a factor having a range expressed as K<1. When the voltage Vf of the fourth capacitor 73, which is detected in the dividing voltage element 77, is approximately equal to K times Vp, a period signal generator 78 outputs the signal IGf The signal IGf includes a pulse having a predetermined width.

As described above, and with reference to FIG. 13, the fourth capacitor 73 stores the electric charges depending on ignition timing signal IGt. Specifically, the voltage Vf of the fourth capacitor 73 increases during the period T1. The voltage Vf may reach its peak at the time t2, which corresponds to the falling edge of the ignition timing signal IGt. After the time t2, the spark plug 21 discharges, and the secondary current I2 flows in the secondary coil 23 of the ignition coil 20. Every time the secondary current I2 flows, the voltage of the fourth capacitor 73 decreases. Then, at the time when the fourth capacitor 73 has the voltage expressed as Vf=Vp×K, the period signal generator 78 outputs the signal IGf.

A period between following two times is approximately expressed as (1−K)×T2; one is a time when the voltage of the fourth capacitor 73 reaches Vf=Vp, and the other is a time when the voltage of the fourth capacitor 73 drops to Vf=K×Vp. Thus the period signal generator 78 may start to output the signal IGf to the ECU 17 during a period between t2 and t3. The ECU 17 calculates an actual multi-spark period, using a ratio of the multi-spark period T2, which is set in the multi-spark period signal IGw, to the actual multi-spark period. The actual multi-spark period is a period during which the spark plug 21 performs the discharges. In the above-described manner, the ECU is capable of determining whether the discharge is performed by the spark plug 21 without faults, and is further capable of detecting abnormal behavior of the ignition control device 10 at an early point.

In the present embodiment, the drive circuit 15 can recognize the multi-spark period T2 in advance of the spark, similar to the case according to the first embodiment.

An ignition control device according to the above-described embodiment includes following advantages.

During the discharging of the spark plug 21, the IGf signal generation unit 70 determines whether the spark plug 21 discharges appropriately or not based on the secondary current flowing in the secondary coil 23 of the ignition coil 20. The IGf signal generation unit 70 outputs the discharge signal IGf based on the following two periods. One is the multi-spark period T2. The other is a period between the time when a voltage of the capacitor 73 reaches a peak voltages Vf=Vp and a time when a voltage of the capacitor 73 drops to Vf=K×Vp. The ECU 17 receives the multi-spark period signal IGw and the discharge signal IGf. The actual multi-spark period is calculated with using the ratio of the multi-spark period T2 which is set in the multi-spark period signal IGw, to the actual multi-spark period. In the above-described manner, the ECU is capable of determining whether the discharges are performed by the spark plug 21 without faults, and is capable of detecting abnormal behavior of the ignition control device 10 at an early point.

While the invention has been described with reference to preferred embodiments thereof, it is to be understood that the invention is not limited to the preferred embodiments and constructions. The invention is intended to cover various modification and equivalent arrangements. In addition, while the various combinations and configurations, which are preferred, other combinations and configurations, including more, less or only a single element, are also within the spirit and scope of the invention.

What is claimed is:

1. An ignition control device for controlling a multi-spark operation associated with an internal combustion engine, comprising:

an ignition coil including a primary coil and a secondary coil;

a first electric energy generator for generating a first electric energy;

a second electric energy generator for generating a second electric energy, a voltage of the second electric energy being larger than a voltage of the first electric energy;

a switching element capable of controlling the supplying of the first electric energy and the second electric energy to the primary coil by switching on and off, the switching causing a secondary current of the secondary coil;

an ignition timing signal generator for generating an ignition timing signal having a pulse waveform based on a driving state of the internal combustion engine;

a multi-spark period setting element for setting a multi-spark period of the multi-spark operation based on a width of the ignition timing signal; and an ignition control element for setting an amount of electric power supplied to the first electric energy generator and the second electric energy generator based on the multi-spark period set by the multi-spark period setting element, and for controlling the switching element.

2. The ignition control device according to claim 1, wherein the multi-spark period setting element sets the multi-spark period based on the width of the ignition timing signal having the pulse waveform, the width being between a rising edge and a falling edge, and the ignition control element commands an ignition at a time corresponding to the falling edge of the ignition timing signal.

3. The ignition control device according to claim 2, wherein the multi-spark period setting element sets the multi-spark period so as to have one-to-one correspondence with the width of the ignition timing signal.

4. The ignition control device according to claim 2, wherein the multi-spark period setting element sets the multi-spark period such that the multi-spark period setting element changes the width of the ignition timing signal having the pulse wave form by a predetermined ratio.

5. The ignition control device according to claim 1, further comprising:

a charging element for storing the first electric energy generated by the first electric energy generator and the second electric energy generated by the second electric energy generator, the charging element disposed between the ignition coil and the generators (30, 40), wherein the charging element is configured to be in a state that the charging element is capable of being charged at any time.

6. The ignition control device according to claim 5, wherein the charging element is capable of being almost completely charged in advance of a time corresponding to the falling edge of the ignition timing signal.

7. The ignition control device according to claim 5, wherein the first electric energy generator includes a first DC/DC converter, and the second electric energy generator includes a second DC/DC converter.

8. The ignition control device according to claim 1, wherein, the ignition control element determines and sets the amount of the electric power supplied to the first electric generator and the second electric generator before the performing of the multi-spark operation is started.

9. The ignition control device according to claim 8, wherein the amount of the electric power supplied to the first electric generator and the second electric generator is the least amount necessary to perform the multi-spark operation.

10. The ignition control device according to claim 1, wherein the ignition timing signal generator sets the width of the ignition timing signal based on the driving state of the engine.

11. The ignition control device according to claim 4, wherein, the predetermined ratio is set in accordance with the driving state of the internal combustion engine.

12. The ignition control device according to claim 11, wherein the predetermined ratio is further set in accordance with an inherent characteristic of various internal combustion engines.

13. The ignition control device according to claim 1, wherein, the first electrical energy is used for ensuring the secondary current of the ignition coil 20.

14. The ignition control device according to claim 1, wherein, the first electrical energy is used for reigniting an air-fuel mixture associated with the internal combustion engine during the multi-spark operation.

15. The ignition control device according to claim 1, further comprising:

an ignition state detection unit for detecting the abnormal discharging of a spark plug.

16. The ignition control device according to claim 15, wherein the ignition state detection unit further provides an early detection of abnormal behavior of the ignition control element based on the detecting the abnormal behavior of the spark plug.

17. An ignition control device for controlling a multi-spark operation associated with an internal combustion engine, comprising:

a secondary electric energy generator generating an electric energy to reignite an air fuel-mixture associated with the internal combustion engine during the multi-spark operation;

a switching element capable of controlling the supplying of the electric energy to a primary coil of an ignition coil, the controlling causing a secondary current in a secondary coil of the ignition coil;

an ignition timing signal generator generating an ignition timing signal based on a driving state of the internal combustion engine;

a multi-spark period setting element setting a multi-spark period of the multi-spark operation based on the ignition timing signal; and an ignition control element setting an amount of electric power supplied to the secondary electric energy generator based on the multi-spark period before the performing of the multi-spark operation is started, and for controlling the switching element.

18. The ignition control device according to claim 17, wherein a length of multi-spark period is inversely proportional to a flow speed of the air-fuel mixture, the flow speed correlated to a revolving speed of the internal combustion engine.

* * * * *